United States Patent [19]

Michalik

[11] Patent Number: 4,951,967

[45] Date of Patent: Aug. 28, 1990

[54] SIGNATURE PERFORATING KNIFE AND SIGNATURE

[75] Inventor: Horst B. Michalik, Höchberg, Fed. Rep. of Germany

[73] Assignee: Koenig & Bauer Aktiengesellschaft, Würzburg, Fed. Rep. of Germany

[21] Appl. No.: 243,722

[22] Filed: Sep. 13, 1988

[30] Foreign Application Priority Data

Sep. 16, 1987 [DE] Fed. Rep. of Germany ..... 3731117

[51] Int. Cl.[5] ..... B42D 13/00

[52] U.S. Cl. ..... 281/2; 83/660; 281/21.1; 281/5

[58] Field of Search ..... 281/2, 5, 21.1; 283/62; 83/660

[56] References Cited

U.S. PATENT DOCUMENTS

| | | | |
|---|---|---|---|
| 2,176,815 | 10/1939 | Hirohashi | 281/21.1 X |
| 2,343,119 | 11/1941 | Zaslawsky . | |
| 2,700,556 | 1/1955 | Holmwood | 281/5 |
| 2,775,448 | 12/1956 | Baker et al. . | |
| 2,782,056 | 2/1957 | Allegretti | 281/21.1 |
| 3,228,710 | 1/1966 | Chodorowski . | |
| 3,343,851 | 9/1967 | Bensler, Sr. et al. | 281/5 |
| 3,809,410 | 5/1974 | Johnson et al. | 281/5 |

*Primary Examiner*—Paul A. Bell

*Attorney, Agent, or Firm*—Jones, Tullar & Cooper

[57] ABSTRACT

A signature formed as a plurality of layers of paper sheets and having a fold line is provided along the fold line with a line of spaced perforations. This line of perforations is formed by a signature perforating knife which has a plurality of spaced perforating teeth. The folded signature avoids creases and bulges during stacking of plural signatures.

5 Claims, 5 Drawing Sheets

SIGNATURE PERFORATING KNIFE AND SIGNATURE

FIELD OF THE INVENTION

The present invention is directed generally to a signature perforating knife and to a perforated signature. More particularly, the present invention is directed to a signature perforating knife having a plurality of spaced signature perforating teeth. Most specifically the present invention is directed to a signature perforating knife having a plurality of spaced teeth which each have a base cutting edge and side cutting edges. This signature perforating knife forms a perforation pattern in the signature which consist of adjacent perforation, both on the fold line and generally transverse to it, that are spaced by small gaps. These perforated signatures are able to be folded without the formation of unwanted creases or the like.

DESCRIPTION OF THE PRIOR ART

In the production of folded printed sheets, which are generally identified as signatures, a plurality of individually printed sheets are placed atop each other and are then folded to produce a signature. Several of these signatures may then be further associated with each other and bound or otherwise joined together to arrive at a book or a magazine.

It is generally known in the prior art to form perforations in the signatures prior to folding so that unwanted creases in the folded product will be minimized. In U.S. Pat. No. 2,775,448 there are disclosed two methods and devices for their implementation by means of which first a perforation is made in a signature and then folding is performed along this perforation. In the first method, longitudinal slits are made along and on top of a fold line. These slits have a distance from each other exactly corresponding to the length of the slits. In the second method, slits are made which extend crosswise to the fold line and which are equally spaced from each other.

Longitudinal slits formed in a signature define a fold and avoid the formation of creases in a possible subsequent fold, in particular in the neighboring area of the subsequent fold. However, this is only true for thin-layered products. With multi-layer folding products, for example telephone directory or magazine sections, the formation of creases, in particular towards the edges, cannot be avoided, because the uncut areas remaining between the longitudinal slits are wide. Because of this, it is not possible to compensate for dislocations with respect to each other of the two pages separated by the fold which are necessary on account of a subsequent second fold extending perpendicularly to the first fold.

The application of slits crosswise to the fold line has been tried to avoid the formation of creases. However, there is the disadvantage of a solid fold line no longer being defined. Additionally, an unwanted formation of bulges in the area of the fold occurs, which makes stacking of the products more difficult. Thus the prior art attempts to form perforated signatures have not been completely satisfactory and have not overcome the problems of paper creasing. The prior art perforating knives have also not been easily replaced or sharpened and have been difficult to use. Accordingly, there is a need for a signature perforating knife which will produce perforated signatures that can be folded without creasing. The signature perforating knife of the present invention provides perforated signature in accordance with the present invention that are properly foldable and are a significant advance in the art.

SUMMARY OF THE INVENTION

It is an object of the present invention to provide a signature perforating knife.

Another object of the present invention is to provide a signature perforating knife having spaced signature perforating teeth.

A further object of the present invention is to provide a signature perforating knife having spaced teeth each of which includes a base cutting edge and at least one lateral cutting edge.

Still another object of the present invention is to provide a perforated signature.

Yet a further object of the present invention is to provide a perforated signature having a plurality of spaced perforations.

Even still another object of the present invention is to provide a perforated signature having spaced perforations along a fold line and also having laterally extending sIde cuts which are generally parallel to each other.

As will be discussed in greater detail in the description of the preferred embodiments which is set forth subsequently, the signature perforating knives in accordance with the present invention utilize a plurality of spaced cutting teeth, each of which is provided with a base cutting edge and at least one lateral cutting edge, to form a plurality of perforations in a signature. The signatures produced by the signature perforating knives of the present invention are as free of compression lines after folding along an intended fold line as possible. The signature perforating knives of the present invention are used to perforate these signatures along the intended fold line so that the signatures, after folding will be as crease free as possible.

Signatures having a large member of pages, such as for example as many as 64 pages, can be produced using the signature perforating knife of the present invention. These thick signatures can be satisfactorily stacked because the formation of bulge and compression folds is almost completely eliminated.

The spaced perforating teeth of the perforating knives can be re-ground so that the total service life of the perforating knife is very long. Additionally, the knife is adjustable in height, so that the perforating teeth of the perforating knife which extend beyond the periphery of the cutting cylinder can be set exactly to a preselected degree. A two-part structure of the perforating knife allows separate replacement of the two halves of the perforating knife. The perforating knife halves are identical and therefore can be produced cost-effectively.

The signature perforating knives of the present invention produce perforated signatures which can be folded and stacked without bulges and creases. Thus they are superior to prior art devices and provides a significant advance in the art.

BRIEF DESCRIPTION OF THE DRAWINGS

While the novel feature of the signature perforating knife and signature in accordance with the present invention are set forth with particularity in the appended claims, a full and complete understanding of the invention may be had by referring to the detailed description of the preferred embodiment, as is set forth subsequently, and as illustrated in the accompanying drawings in which:

DETAILED DESCRIPTION OF THE PREFERRED EMBODIMENTS

Figure 4:
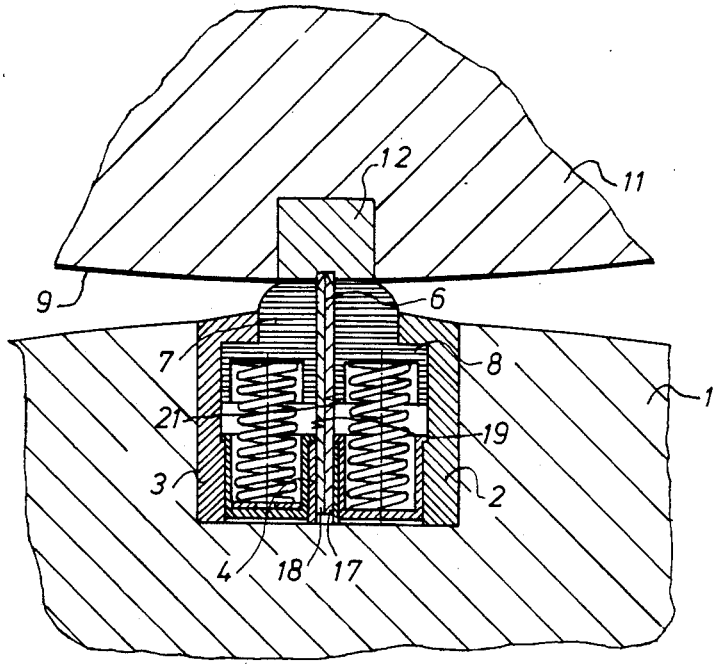
FIG. 4 is a cross-sectional view of a perforating cylinder and showing a knife block and perforating knife.

Referring initially to FIG. 4 there may be seen a portion of a folding mechanism of a rotary printing press which includes a perforating cylinder 1 and a cooperating counter perforating cylinder 11. The perforating cylinder 1 has a knife block 3 in a groove 2 which extends the width of the cylinder. The knife block 3 includes a support 4 for a perforating knife 6. Looking in the direction of rotation of the perforating cylinder 1, a pair of spaced spring-loaded hold-down devices 7 and 8 are provided respectively ahead of and behind the perforating knife 6. The hold-down devices 7 and 8 press a signature 9 against the counter perforating cylinder 11 and thus prevent sliding of the signature 9 during the perforating operation. The perforating knife 6 cooperates with an opposed elastic bar 12 which is carried by the counter perforating cylinder 11.

Figure 1:
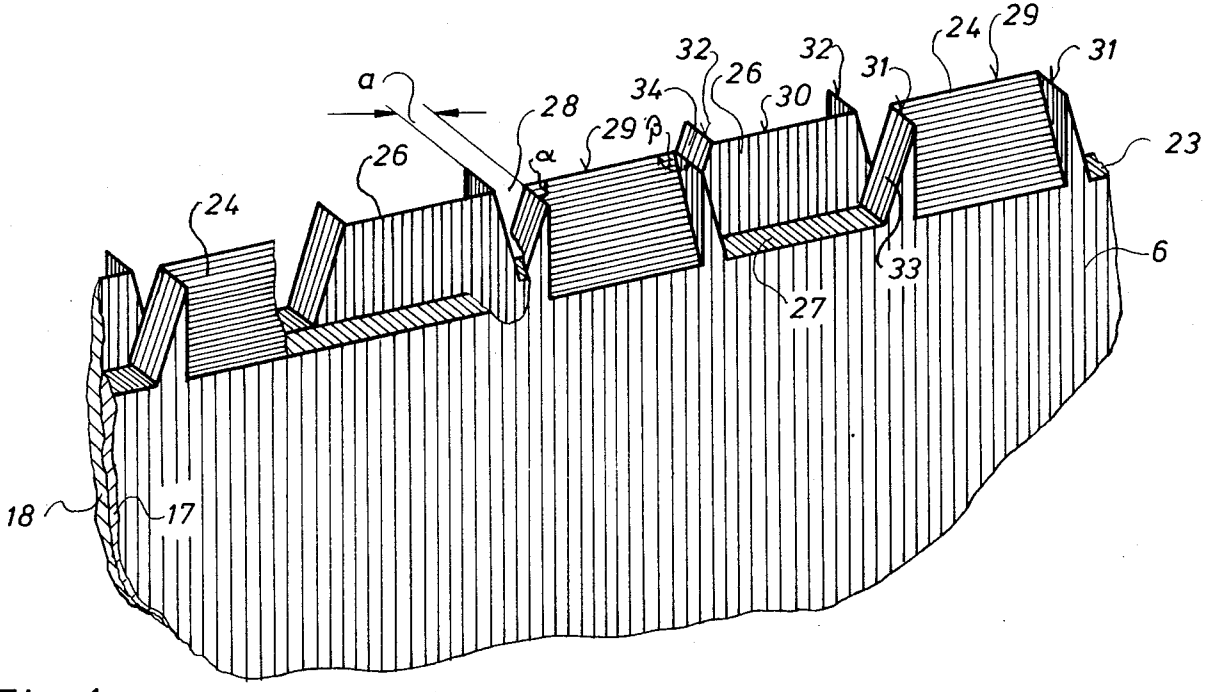
FIG. 1 is a perspective view of a portion of a first preferred embodiment of a signature perforating knife in accordance with the present invention and showing the perforating teeth.

As may be seen in FIG. 4, and in more detail in FIG. 1, a first preferred embodiment of a signature perforating knife, generally at 6, may be formed as two halves and consists of two thin-walled pieces of sheet steel 17 and 18 (e.g., 1 mm) which are somewhat wider than the signature 9. The steel blade halves 17 and 18, in a preferred configuration, are identical to each other and both are fastened together with their backs 19 and 21 on the knife block 3 in such a way that they compliment each other in their operation in the manner of a single blade.

Each steel piece 17 or 18 has, on an upper edge 23, a plurality of perforating teeth 24 and 26. All of these perforating teeth 24 and 26, with the exception of perforating teeth 24.1 and 26.1 which are each disposed in the center of the knife, have the same tooth width and are placed at such a distance from each other that a gap 27 or 28 is created between each of the adjoining perforating teeth 24 and 24 or 26 and 26 on the blade halves 17 and 18. The perforating teeth 24.1 and 26.1 disposed in the center of each steel blade half and 17 and 18 are somewhat wider than the remainder of the perforating teeth 24 and 26. For this reason there is no gap between the perforating teeth 24.1 and 26.1 when the backs of the two perforating knife halves 17 and 18 of perforating knife 6 are placed against each other.

Gaps 27 between spaced perforating teeth 24 and gaps 28 between spaced perforating teeth 26 on blade halves 17 and 18 respectively are somewhat wider than the teeth 24 and 26. This results, when the blade halves 17 and 18 are assembled to form perforating blade 6, in a small slit "a" which preferably has a width of generally about 0.5 to 3 mm being formed between adjacent signature perforating teeth 24 and 26. As may be seen most clearly in FIG. 1, a perforating tooth 24 on first blade half 17 is aligned with a gap 28 on second blade half 18. Similarly tooth 26 on the second blade half 18 overlies a gap 27 on the first blade half 17.

Each perforating tooth 24 and 26 is ground in a chisel-like manner on one side to a base cutting edge 29 and 30 and has two lateral cutting edges 31 and 32 on its inclined flanks 33 and 34. The lateral cutting or side edges 31 and 32 are connected with the ends of the base cutting edges 29 and 30 and are each disposed at an angle $\alpha$, $\beta$ (e.g., $\alpha=\beta=90°$) to the base cutting edges 29 and 30. It is also possible to provide the angles $\alpha$ and $\beta$ with different values. All of the base cutting edges 29 and 30 of the perforating teeth 24 and 26, as well as base cutting edges 29 and 30 of center perforating teeth 24.1 and 26.1 are located on a common straight line 37 which is depicted in FIG. 2.

As may be seen most clearly in FIG. 1 the base cutting edges 29 and 30 cooperate with the side or lateral cutting edges 31 and 32 of cutting teeth 24 and 26 to form generally U-shaped cutting patterns. As may also be seen, the side cutting edges 31 and 32 of adjacent perforating teeth 24 and 26 are oppositely disposed in relation to each other. By alternately disposed it is meant that the base cutting edges 29 and 30; of all perforating teeth 24, 26, 24.1 and 26.1; are located on or near the common straight line 37 and that the two lateral cutting edges 31, 32; of two immediately adjacent perforating teeth 24, 26, 24.1 and 26.1; are each turned with respect to each other by 180° around the straight line 37.

The perforating knife 6 has on its lower edge 43 a plurality of rectangular recesses 44, by means of which is can be moved vertically but not horizontally. A plurality of rectangular recesses 50, also on the lower edge 43 of the perforating knife 6, are used to receive adjusting shims (not shown). It is, also possible to make the perforating knife 6 of one piece.

Figures 2, 3:
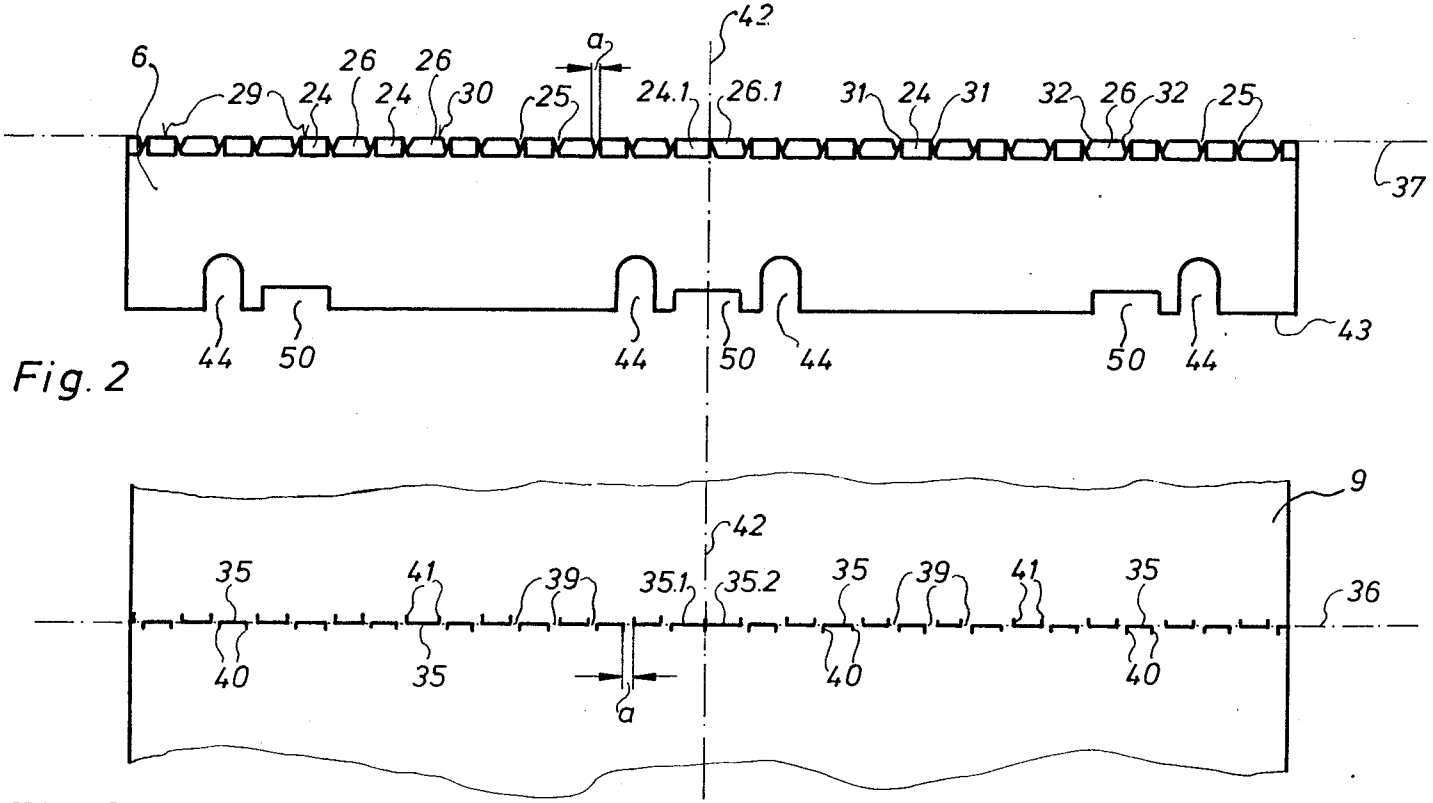
FIG. 2 is a side elevation view of the perforating knife of FIG. 1.
FIG. 3 is a top plan view of a fold line portion of a perforated signature in accordance with the present invention.

The perforating knife 6 makes a perforation in a multi-layer signature 9 in such a way that the signature 9 shows, along the fold line 36, or in its vicinity (e.g., ±0.2 mm), a plurality of alternately extending U-shaped perforations 35, 40, and 41, as seen most clearly in FIG. 3. By alternately extending it is meant that the base cuts 35, 35.1, 35.2; of all perforations 35, 40, 41; are located on, or in the vicinity of, the intended fold line 36 and the two lateral cuts 40, 41; of two immediately adjacent perforations 35, 40, 41; are each turned by 180° around the intended fold line 36 in signature plane 9.

Between each of the lateral cuts 40, 41 created by the lateral cutting edges 31, 32 of the perforating teeth 24, 26 a small web 39 remains. Only between the two wider base cuts 35.1, 35.2 made by the cutting teeth 24.1 and 26.1 no web 39 remains so that the fold line 36 shows a slit of double length in that position which is preferably made in the center of the signature in the area of a subsequent longitudinal fold 42.

Figure 5:
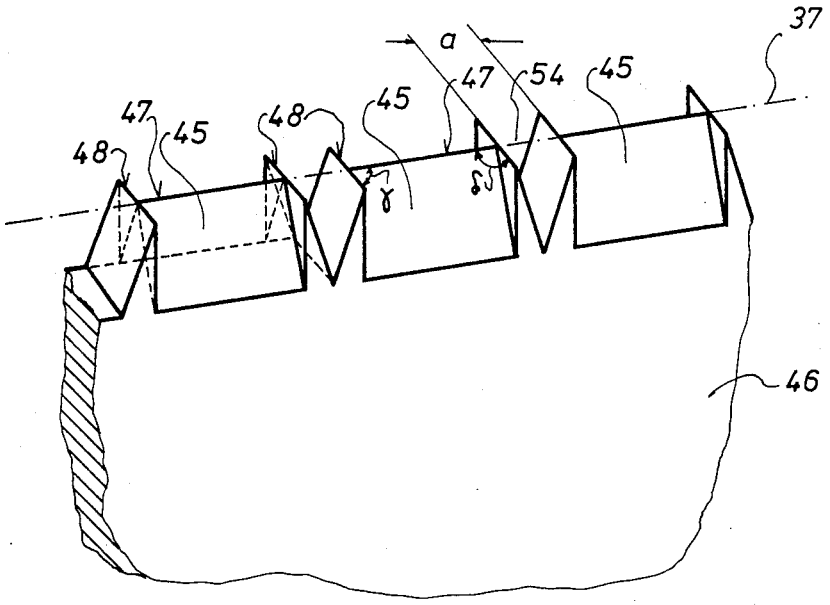
FIG. 5 is a perspective view of a portion of a second preferred embodiment of a signature perforating knife in accordance with the present invention.

In a second preferred embodiment, as seen in FIG. 5, a perforating knife 46 has a plurality of perforating teeth 45 disposed at a distance "a" from each other. The base and side cutting edges 47 and 48 of the perforating teeth 45 are H-shaped and the base cutting edges 47 of the perforating teeth 45 are disposed on a common straight line 37. The perforating teeth 45 ere separated from each other by a gap 54. Only two of the perforating teeth 45, which are disposed in the center in the area of the intended longitudinal fold 42, are disposed closely side by side so that there is no gap "a" between the center perforating teeth 45. The lateral or side cutting edges 48 are each disposed at the ends of the base cutting edges 47 at an angle $\Gamma$, $\delta$(e.g. $=\delta=90°$) to the base cutting edges 47. Of course, the angles $\Gamma$, $\delta$ may be different value. However, it is advantageous that the two immediately adjacent cutting edges 48 which form the gap 54 be parallel.

Figure 6:
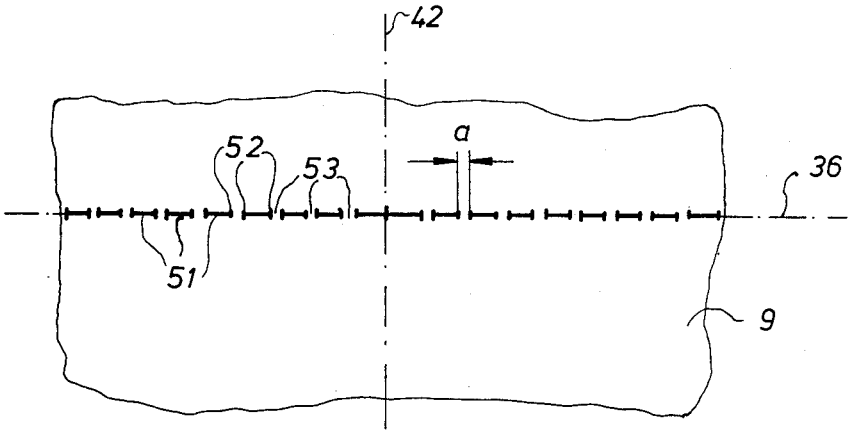
FIG. 6 is a top plan view of a perforated signature fold line made by the second preferred embodiment of the signature perforating knife.

The second preferred embodiment of perforating knife 46 makes perforations 51 and 52 in a multi-layer signature 9 as seen in FIG. 6, in such a way that the signature 9, shows along or in the vicinity of the fold line 36, a plurality of extended H-shaped perforations 51, 52. Between each of the lateral cuts 52 created by the lateral cutting edges 48 a small web 53 remains, only no web 53 remains between two base cuts 51 made in the signature center 42.

Figure 7:
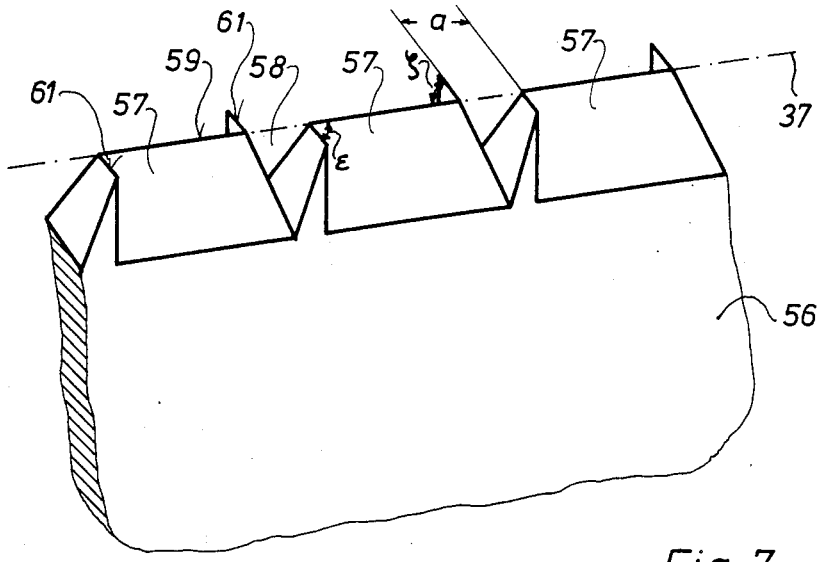
FIG. 7 is a perspective view of a portion of a third preferred embodiment of a signature perforating knife in accordance with the present invention.

In a third preferred embodiment, as seen in FIG. 7, a perforating knife 56 has a plurality of perforating teeth 57 disposed at a distance "a" from each other. The cutting edges 59, 61 of the cutting teeth 57 are in the shape of a horizontal crank which means that the base cutting edges 59, which correspond to a connecting rod, are disposed on a common straight line, and the lateral cutting edges 61 of the perforating teeth 57 which correspond to the crank pin of two immediately adjacent perforating teeth 57 are each separated from each other by a gap 58. Only two perforating teeth 57, each disposed in the center in the area of the intended longitudinal fold 42, are disposed closely side by side.

The cutting edges 61 are each disposed at the ends of the cutting edges 59 at an angle $\epsilon$, $\phi$ (e.g., $\epsilon=\phi=90°$) to cutting edges 59. Of course, the angle $\epsilon$, $\phi$ may be of different value. However, it is advantageous that two immediately adjacent lateral cutting edges 61 which form the gap 58, or their extensions, are parallel.

Figure 8:
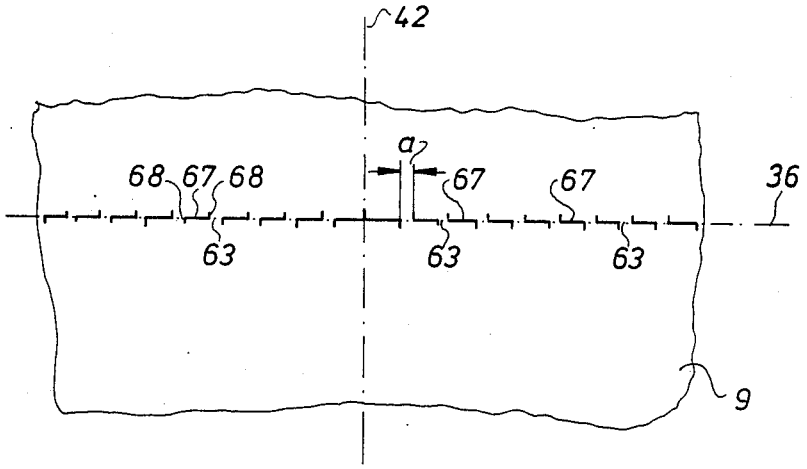
FIG. 8 is a top plan view of a perforated signature fold line made by the third preferred embodiment of the signature perforating knife.

The perforating knife 56 makes a perforation 67 and 68 in a multi-layer signature 9, as shown in FIG. 8, in such a way that the signature 9 has along, or in the vicinity of the fold line 36, a plurality of extended perforations 67, 68 in the shape of a horizontal crank, which means that the base cuts 67, each corresponding to a connecting rod, are located on a common fold line 36, and the lateral cuts 68 corresponding to the crank pins are disposed alternately to each other. The crank pins 68, seen from the direction of the connecting rod 67, point counterclockwise up to the left of the signature center 42 and clockwise at the right of signature center 42.

Between the lateral cuts 68 created by the lateral cutting edges 61, small web 63 remains. Only the perforation 67, 68 disposed in the signature center in the area of the longitudinal fold 42 has a perforation 67, 68 consisting of two opposite cranks which does not form a web 63 between the balanced lateral cuts 68.

The signature perforating knives of the present invention produce perforated signatures which have perforations that are both generally along and also generally transverse to the primary fold line on the signatures. This arrangement of perforations allow the signatures to be folded along the primary fold line in a manner which results in the elimination of unwanted creases. The perforating knives may be made in two pieces and may be re-sharpened as needed.

While preferred embodiments of a signature perforating knife and signature have been fully and completely set forth hereinabove it will be apparent to one of skill in the art that a number of changes in, for example, the type of material used for the cutting blade, the sizes of the perforating teeth, the blade position adjusting means and the like could be made without departing from the true spirit and scope of the subject invention which is accordingly to be limited only by the following claims.

What is claimed is:

1. A foldable signature having a plurality of paper sheets, said foldable signature being foldable along an elongated fold line, said elongated fold line having a plurality of spaced perforations extending through said plurality of paper sheets, each of said spaced perforations having a base cut which is generally at, and generally parallel to said elongated fold line, and a least a first lateral cut which extends outwardly from an end of said base cut, each of said perforations being spaced from adjacent perforations by a small web.

2. The foldable signature of claim 1 wherein each of said spaced perforations is generally U-shaped with each of said U-shaped perforations having said base cut and having said first lateral cut and a second lateral cut extending outwardly from first and second ends of said base cut, said lateral cuts of adjacent ones of said generally U-shaped perforations extending generally outwardly in generally opposing directions.

3. The foldable signature of claim 1 wherein each of said spaced perforations is generally H-shaped with each of said generally H-shaped perforations having said base cut and having said first lateral cut and a second lateral cut extending outwardly from first and second ends of said base cut, each of said first and second lateral cuts of each of said spaced, generally H-shaped perforations extending generally outwardly to both sides of each said base cut.

4. The foldable signature of claim 1 wherein each of said spaced perforations is generally crank shaped with each of said generally crank shaped perforations having said base cut and having said first lateral cut and a second lateral cut extending outwardly from first and second ends of said base cut, said first and second lateral cuts of each of said spaced generally crank shaped perforations extending generally outwardly in opposing directions from said base cut.

5. The foldable signature of claim 4 wherein said crank shaped perforations on a first side of a center of said foldable signature point counterclockwise and further wherein said crank shaped perforations on a second side of said center of said foldable signature point clockwise.

* * * * *